US006286727B1

(12) United States Patent
Keung

(10) Patent No.: US 6,286,727 B1
(45) **Date of Patent: *Sep. 11, 2001**

(54) PUMP DISPENSER HAVING ERGONOMIC OVERHANG AND METHOD OF MAKING IT

(75) Inventor: Wing-Kwong Keung, Perrysburg, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/564,845

(22) Filed: May 4, 2000

(51) Int. Cl.[7] ..... B67D 5/40
(52) U.S. Cl. ..... 222/383.1; 239/333
(58) Field of Search ..... 222/383.1; 239/333, 239/493; 264/328.1, 318

(56) References Cited

U.S. PATENT DOCUMENTS

| | | | | |
|---|---|---|---|---|
| 4,161,288 | | 7/1979 | McKinney . | |
| 4,819,835 | * | 4/1989 | Tasaki | 222/383 |
| 4,953,791 | * | 9/1990 | Tada | 239/333 |
| 5,590,834 | | 1/1997 | Foster . | |
| 5,603,434 | | 2/1997 | von Schuckmann . | |
| 5,626,259 | * | 5/1997 | Mass et al. | 222/136 |
| 5,656,227 | | 8/1997 | Foster . | |
| 6,032,834 | * | 3/2000 | Keung | 222/383.1 |

* cited by examiner

*Primary Examiner*—Kevin Shaver
*Assistant Examiner*—Frederick C Nicolas

(57) ABSTRACT

One-piece pump body to be attached to a container has nozzle at one end and overhang at the other. Portion of overhang which engages the web of the user's hand is molded from the bottom up to provide a plurality of closely spaced ribs having rounded bottom end surfaces extending below the side walls of pump and present an ergonomic surface.

9 Claims, 2 Drawing Sheets

PUMP DISPENSER HAVING ERGONOMIC OVERHANG AND METHOD OF MAKING IT

FIELD OF THE INVENTION

This invention relates to a pump dispenser of the hand-powered type and comprising a container and a pump body mounted on the container. More specifically, this invention relates to such a pump dispenser in which the pump body has an overhang engaged by the dorsal web between the thumb and forefinger of the user's hand. Still more specifically, the invention relates to the method of making such a pump dispenser which may be molded in one piece.

BACKGROUND OF THE INVENTION

The prior art is replete with examples of hand-powered pump dispensers which comprise a pump body mounted on a container. The pump body includes a nozzle on the front end and an overhang on the rear end. The pump may include a vertically disposed cylinder having a piston operatively disposed within it such as shown, for example, in the McKinney U.S. Pat. No. 4,161,288 issued Jul. 17, 1979.

In a relatively recent development, the manufacture of such pump bodies in one piece has been disclosed in my patent application Ser. No. 09/176,752, filed Oct. 22, 1998, now U.S. Pat. No. 6,032,834 and assigned to the assignee of the present application. This disclosure describes molding the pump body from the bottom up whereby the lower mold part extends into the cavity of the upper mold part to structure the body parts as desired. Because the sloping rear end of the pump body and the top wall are uninterrupted surfaces, the pumps made under this disclosure appear conventional and unremarkable.

The present invention is based on the idea in a one-piece pump of providing the overhang with a comfortable ergonomic surface to be engaged by the dorsal web of the hand of the user in operation.

SUMMARY OF THE INVENTION

The present invention is a pump dispenser comprising a one-piece unitary molded pump body and housing, the housing defined by a pair of spaced side walls and a top wall and inclined rear wall connected to the side walls. A vertically disposed tubular support and pump cylinder is spaced inward from the side walls unitary with and meeting the top wall. The body and housing have a cavity under the inclined rear wall formed with a plurality of closely spaced transverse webs extending between and integral with the side walls. The webs have rounded lower edges extending downward at least to the level of the lower end of adjacent portions of the side walls to form an ergonomic surface without substantially affecting the side profile of the dispenser. The dispenser may additionally include an intersecting web in the recess parallel to and between the side walls and intercepting the transverse webs.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
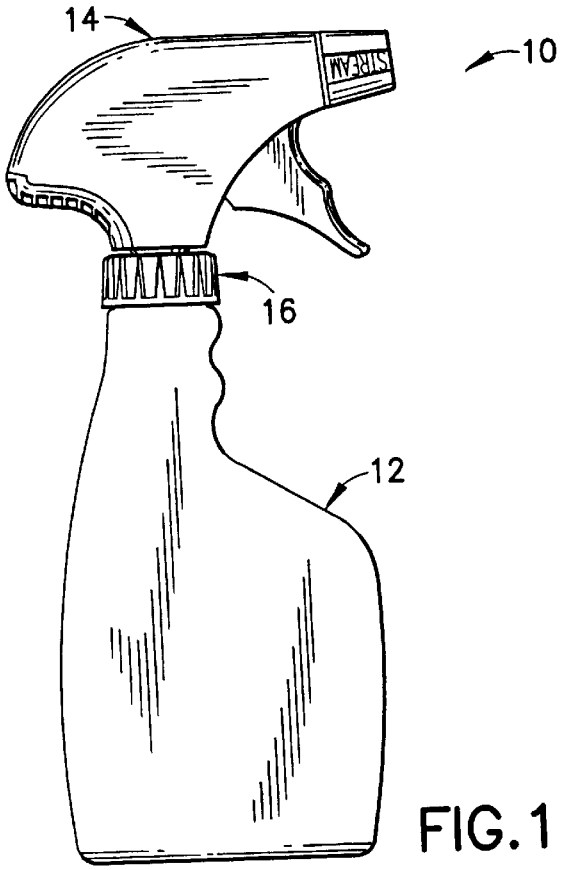
FIG. 1 is a side elevation of a pump dispenser embodying the invention.

A pump dispenser embodying the invention is shown in FIG. 1 and generally designated 10. It comprises a container 12 and a pump body 14. A suitable threaded collar 16 connects the container and pump body as is conventional. The pump body (FIG. 2) includes parallel side walls 18 and a curving top wall 20 blending into an inclined rear wall 21. On the front end of the body are disposed the nozzle cap 22 and the pivoted trigger 24, all as described in my patent mentioned above.

Figure 5:
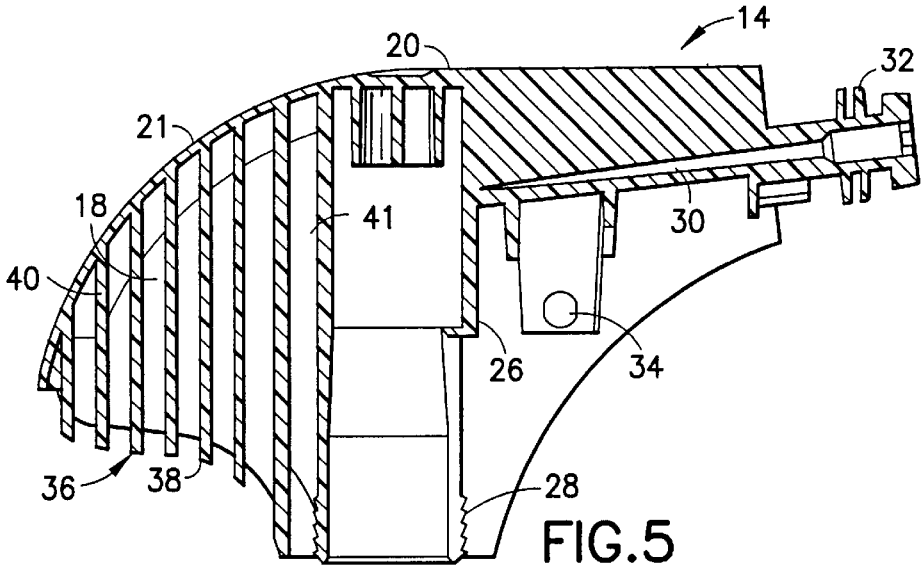
FIG. 5 is a sectional view taken on the line 5—5 of FIG. 4.

Referring to FIG. 5, the pump body 14 is molded in one piece. It includes a vertically disposed cylinder 26 and a coaxial tubular support 28. From the cylinder a delivery tube 30 extends forward to a nozzle 32. Transverse trigger supporting pins 34 are provided and shaped as described in the patent.

Extending upward from the lower end of the side walls is an overhang generally designated 36. In place of the usual curving saddle, which is common to pump bodies not molded in one piece, the present body 14 has an overhang comprising bottom end surfaces 38 of a plurality of closely spaced parallel webs 40 separated by spaces 41. These webs 40 extend between the side walls 18 and are molded by a plurality of blades (not shown) in the lower half of the mold. These blades extend up into the cavity of the upper mold half when the pump body is molded.

The webs 40 g(FIG. 2) are intercepted by a center line intersecting web 42 parallel to the side walls to give the webs 40 additional stability. To form the center line web 42, the blades referred to above (not shown) forming the spaces 41 between the webs 38 are formed with elongated center line slots.

Figure 2:
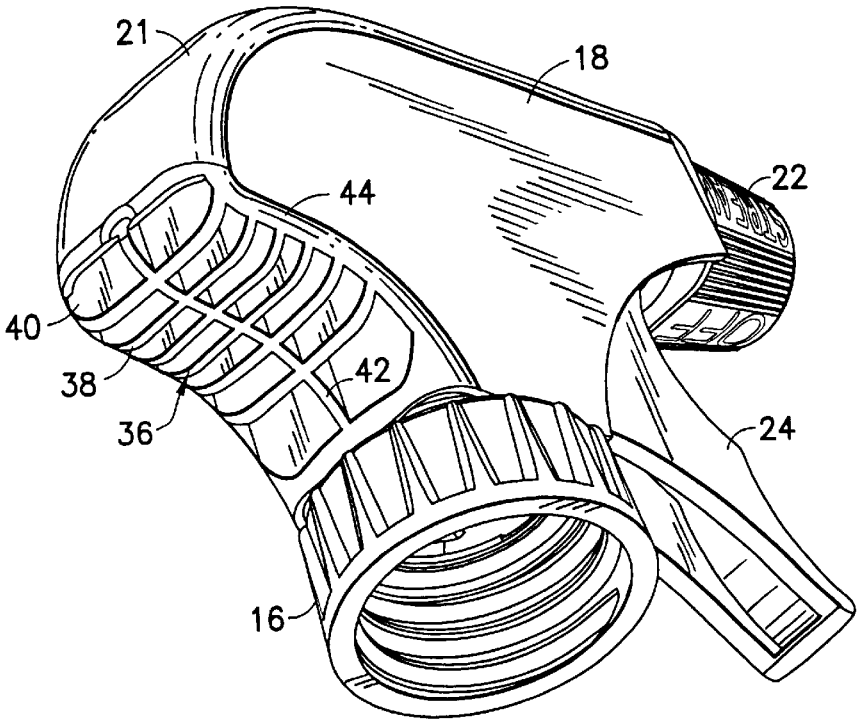
FIG. 2 is an enlarged perspective view from below and to the rear of the pump body.
Figure 3:
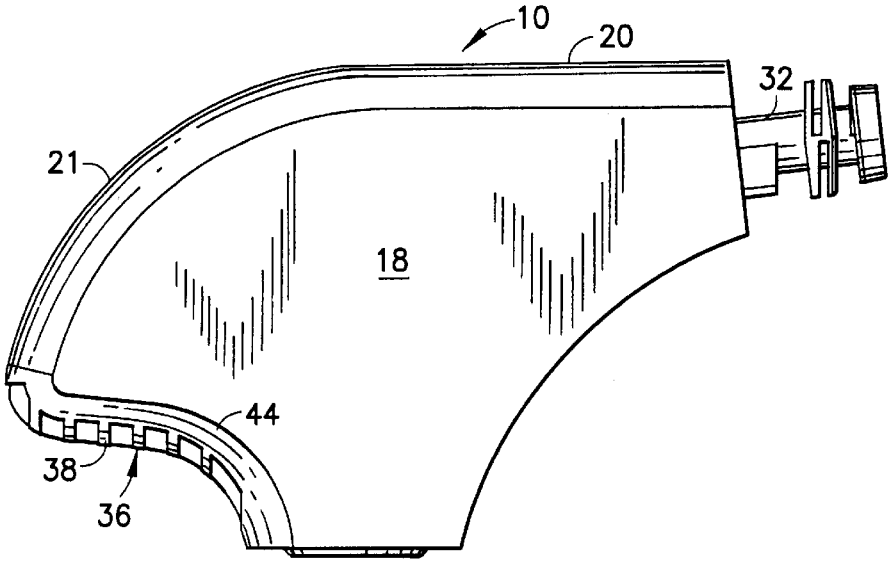
FIG. 3 is an enlarged side view of the pump body.
Figure 4:
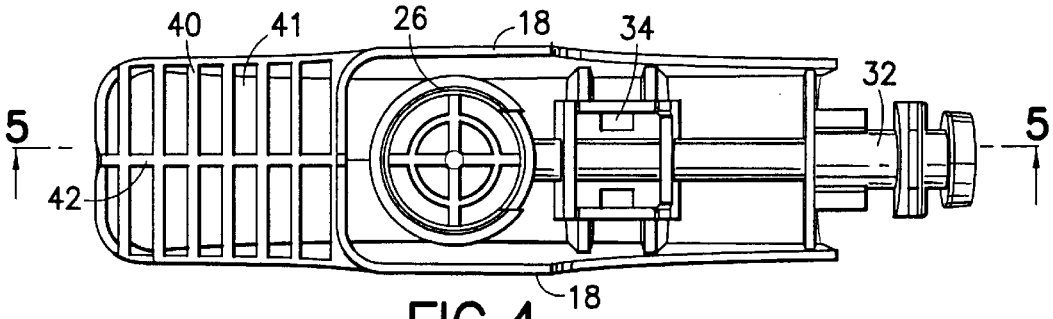
FIG. 4 is a bottom plan view.

Attention is now directed to the underside of the overhang 36 as shown in FIGS. 2 and 3. The bottom surfaces 38 of the webs 40 are rounded as shown and closely spaced. They extend down beyond the lower ends of the side walls 18 in the overhang 36 and smoothly blend into the side walls 18 in a comfortable faring 44. As stated, the bottom ends 38 extend beyond the side walls 18 but not to the extent that they affect the side profile of the shape of the pump body to any substantial extent. Even so, because the end surfaces 38 extend down slightly farther than the side walls 18 and because of faring 44, when the dorsal web of the user's hand engages the overhang 36, there is a smooth comfortable feeling in which the weight of the dispenser is distributed evenly over the plurality of closely spaced webs 40.

Indeed, the effect given as similar to that of the conventional overhang saddle with which the market is familiar. Thus, by the provision of the overhang formed by the plurality of lower ends 38 of the webs 40, the present invention makes possible the appearance and "feel" of a conventional plural piece pump body. Yet it is molded in one piece.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A pump dispenser comprising a one-piece unitary molded pump body and housing, the housing defined by a pair of spaced side walls and an imperforate top wall and an imperforate inclined rear wall connected to the top and side walls, a vertically disposed tubular support and pump cylinder spaced inward from the side walls and unitary with and meeting the top wall, the body and housing having a recess under the imperforate inclined rear wall, the recess having a plurality of closely spaced transverse webs extending between and integral with the side walls, the webs having free lower ends extending downward at least to the level of the lower end of adjacent portions of the side walls to form an ergonomic surface without substantially affecting the side profile of the dispenser.

2. A pump dispenser as claimed in claim 1 including additionally a web in the recess parallel to and between the side walls and intersecting the transverse webs.

3. A pump dispenser as claimed in claim 1 wherein the transverse webs are rounded.

4. A pump dispenser as claimed in claim 1 wherein the lower adjacent portions of the side walls are fared to blend into the free ends of the transverse webs.

5. A pump dispenser comprising a container and a one-piece unitary molded pump body and housing mounted on the container, the housing defined by a pair of spaced side walls and an imperforate top wall and an imperforate inclined rear wall connected to the top and side walls, a vertically disposed tubular support and pump cylinder spaced inward from the side walls and unitary with and meeting the top wall, the tubular support being supported on the container, the body and housing having a recess under the imperforate inclined rear wall rearward of the container, the recess having a plurality of closely spaced transverse webs extending between and integral with the side walls, the webs having lower free ends extending downward at least to the level of the lower end of adjacent portions of the side walls to form an ergonomic surface without substantially affecting the side profile of the dispenser.

6. A pump dispenser as claimed in claim 5 including additionally a web in the recess parallel to and between the side walls and intersecting the transverse webs.

7. A pump dispenser as claimed in claim 5 wherein the transverse webs are rounded.

8. A pump dispenser as claimed in claim 5 wherein the lower adjacent portions of the side walls are fared to blend into the ends of the transverse webs.

9. A pump dispenser comprising a one-piece unitary molded pump body and housing, the housing defined by a pair of spaced side walls and a top wall and inclined rear wall connected to the top and side walls, a vertically disposed tubular support and pump cylinder spaced inward from the side walls and unitary with and meeting the top wall, the body and housing having a recess under the inclined rear wall, the recess having a plurality of closely spaced transverse webs extending between and integral with the side walls, the webs having lower ends extending downward at least to the level of the lower end of adjacent portions of the side walls to form an ergonomic surface without substantially affecting the side profile of the dispenser, a web in the recess parallel to and between the side walls and intersecting the transverse webs.

* * * * *